US007293570B2

(12) United States Patent
Jackson

(10) Patent No.: US 7,293,570 B2
(45) Date of Patent: Nov. 13, 2007

(54) CARBON DIOXIDE SNOW APPARATUS

(75) Inventor: David P. Jackson, Saugus, CA (US)

(73) Assignee: Cool Clean Technologies, Inc., Eagan, MN (US)

( * ) Notice: Subject to any disclaimer, the term of this patent is extended or adjusted under 35 U.S.C. 154(b) by 0 days.

(21) Appl. No.: 11/301,442

(22) Filed: Dec. 13, 2005

(65) Prior Publication Data

US 2006/0124156 A1 Jun. 15, 2006

Related U.S. Application Data

(60) Provisional application No. 60/635,230, filed on Dec. 13, 2004.

(51) Int. Cl.
*B08B 3/02* (2006.01)

(52) U.S. Cl. ..... 134/94.1; 134/198; 239/589

(58) Field of Classification Search ..... 134/198, 134/102.1, 94.1; 239/132.5, 589
See application file for complete search history.

(56) References Cited

U.S. PATENT DOCUMENTS 1,972,240 A * 9/1934 Rufener et al. ..... 239/2.2
1,993,696 A * 3/1935 Allen et al. ..... 169/11
2,151,076 A * 3/1939 Betzler ..... 169/30
2,666,279 A * 1/1954 Chalom ..... 451/102
2,978,187 A * 4/1961 Hesson ..... 239/499
3,124,442 A * 3/1964 Rich ..... 62/602
3,435,632 A * 4/1969 Fallin ..... 62/322
3,861,168 A * 1/1975 Sayers ..... 62/388
3,901,322 A * 8/1975 Winston ..... 169/43
3,932,155 A * 1/1976 Pietrucha et al. ..... 62/603
3,971,114 A 7/1976 Dudley
4,015,440 A * 4/1977 Pietrucha et al. ..... 62/166
4,299,429 A * 11/1981 Franklin, Jr. ..... 312/236
4,640,460 A * 2/1987 Franklin, Jr. ..... 239/2.2
4,911,362 A * 3/1990 Delich ..... 239/2.2
5,321,869 A * 6/1994 Kaempf ..... 15/322
5,456,629 A * 10/1995 Bingham ..... 451/39
5,462,468 A * 10/1995 Bailey et al. ..... 445/59
5,497,833 A * 3/1996 Kaylor ..... 169/15

(Continued)

FOREIGN PATENT DOCUMENTS

JP 2001-259555 * 9/2001

OTHER PUBLICATIONS

European Patent Office 0 509 132 Oct. 1992.*

(Continued)

*Primary Examiner*—Frankie L. Stinson
(74) *Attorney, Agent, or Firm*—DuFault Law Firm, P.C.; Dustin R. DuFault

(57) ABSTRACT

A carbon dioxide snow apparatus of the present invention includes a carbon dioxide snow generation system and a propellant generation system connected to a common carbon dioxide gas source. The carbon dioxide snow generation system includes a condenser having a at least two connected segments, wherein a first segment has a lesser diameter than the a second segment to provide a stepped expansion cavity for cooling and condensing liquid carbon dioxide into solid carbon dioxide snow. Several snow generation systems, each separately controllable with separate condensers, may be integrated with the propellant generation system and common carbon dioxide source to provide for a multiplicity of carbon dioxide snow applicators for integration into both manual and automated machining processes.

21 Claims, 13 Drawing Sheets

U.S. PATENT DOCUMENTS 5,553,466 A * 9/1996 Kuzniarski et al. ..... 62/602
5,725,154 A * 3/1998 Jackson ..... 239/135
5,765,394 A * 6/1998 Rhoades ..... 62/603
5,766,061 A 6/1998 Bowers
5,775,127 A 7/1998 Zito
5,836,809 A * 11/1998 Kosic ..... 451/89
5,853,128 A * 12/1998 Bowen et al. ..... 239/329
5,918,817 A * 7/1999 Kanno et al. ..... 239/433
5,925,024 A * 7/1999 Joffe ..... 604/313
5,931,721 A 8/1999 Rose et al.
5,961,041 A 10/1999 Sekihara et al.
6,036,581 A 3/2000 Aoki
6,042,458 A * 3/2000 Lehnig et al. ..... 451/102
6,066,032 A 5/2000 Borden et al.
6,173,916 B1 * 1/2001 Krone-Schmidt ..... 239/590.3
6,177,103 B1 * 1/2001 Pace et al. ..... 424/489
6,203,406 B1 3/2001 Rose et al.
6,343,609 B1 * 2/2002 Kim ..... 134/1.3
6,419,566 B1 7/2002 Palmisano
6,513,336 B2 2/2003 Zurecki et al.
6,564,682 B1 5/2003 Zurecki et al.
6,661,049 B2 * 12/2003 Tzeng et al. ..... 257/296
6,695,686 B1 * 2/2004 Frohlich et al. ..... 451/102
6,708,903 B2 3/2004 Kanno
6,824,450 B2 * 11/2004 Opel ..... 451/53
6,852,173 B2 * 2/2005 Banerjee et al. ..... 134/26
2001/0032479 A1 * 10/2001 Bowers et al. ..... 62/603
2003/0102013 A1 * 6/2003 Jackson ..... 134/21
2003/0207655 A1 11/2003 Jackson
2005/0058836 A1 3/2005 Goldstein
2005/0218076 A1 10/2005 Mehta et al.
2006/0011734 A1 * 1/2006 Kipp ..... 239/11

OTHER PUBLICATIONS

European Patent Office 0 546 359 Jun. 1993.*
Dry Surface Cleaning using CO2 Snow, R.Sherman et al, J.Vac. Sci.Technol. B, vol. 9, No. 4, Jul./Aug. 1991.

* cited by examiner

Spray Impact Pressure
(Shear Stress)

CARBON DIOXIDE SNOW APPARATUS

CROSS-REFERENCE TO RELATED APPLICATION(S)

This application claims the benefit of U.S. Provisional Patent Application No. 60/635,230 entitled METHOD AND APPARATUS FOR SELECTIVE CLEANING AND TREATMENT WITHIN A MANUFACTURING PROCESS filed on 13 Dec. 2004 and which is hereby incorporated herein by reference.

BACKGROUND OF INVENTION

The present invention generally relates to manufacturing tools and procedures. More specifically, the present invention relates to a precision cleaning apparatus and process that can be integrated directly into various manufacturing tools and processes. Manufacturing tools and processes requiring precision cleaning include, among others, die attachment, machining, board cutting, wafer singulation, assembly, rework, inspection, wire bonding, adhesive bonding, soldering, underfilling, dispensing, sealing, dicing, coating and trimming tools. These tools may be designed and developed as stand-alone tools, located on automation lines or integrated into existing Original Equipment of Manufacturers (OEM) tools.

In-situ cleaning processes practiced in the prior art involve a variety of cleaning methods including solvent bathes, aqueous cleaning, ultrasonic cleaning, and liquid spraying. Due to there inherent incompatibilities with process tools, the aforementioned methods are typically performed as a step before or after a manufacturing tool or process. For example, U.S. Pat. No. 4,832,753 issued to Cherry et al., suggests a fully enclosed environmental chamber containing a Freon® 113 solvent sprayer with a high-efficiency particulate air (HEPA) filter and dry air re-circulated within a closed chamber. The apparatus is typical of what would be commonly used as a stand-alone cleaning tool within a manufacturing operation.

There are several examples of the prior art suggesting techniques to integrate carbon dioxide snow into substantially stand-alone cleaning systems to control thermal and electrostatic effects during the use of cryogenic impingement sprays. These techniques include using secondary heated or ionized jets or sprays directed at the substrate surface and delivered either independently or as a component of the cryogenic spray. For example, U.S. Pat. No. 5,354,384 issued to Sneed et al. suggests the use of a heated gas, such as filtered nitrogen, to provide both a pre-heat cycle and a post-heat cycle to a portion of a substrate in a snow spray cleaning process. This approach relies on "banking heat" into the substrate portion prior to the cryogenic spray cleaning by delivering a heated gas stream to a portion of the substrate to prevent moisture deposition and adding heat from a heated gas following cryogenic spray treatment. Another example includes U.S. Pat. No. 5,409,418 issued to Krone-Schmidt et al., which suggests an apparatus for surrounding an impinging cryogenic spray stream with an ionized inert gas. It is proposed by surrounding a stream of solid-gas carbon dioxide with a circular stream of ionized gas and applying the two components to the substrate simultaneously, resulting in controlling or eliminating the electrostatic discharge at the surface during impingement. However, in practice, entrainment and deposition of atmospheric contaminants onto substrate surfaces being treated with the cryogenic spray is resulted. As such, cryogenic spray cleaning applications of the prior art necessitate that the housing of the cryogenic spray applicator, the substrate and the secondary gas jets be enclosed in large, bulky and complex environmental enclosures employing HEPA filtration and dry inert atmospheres.

Another approach is to integrate the cryogenic spray cleaning process into a production tool. For example U.S. Pat. No. 5,001,873 teaches a method for cleaning small Excimer LASER optics in-situ within the sealed chamber comprising the LASER cavity itself Using this invention, each optical surface is provided an individual carbon dioxide spray nozzle, as well as purge gas nozzles, as a means for cleaning particle debris from the optical surfaces between LASER operations. Such an invention provides in-situ cleaning of the production tool components, in this case the LASER optical surfaces. However, the '873 invention does not teach an apparatus for generating and controlled such a cleaning spray. More importantly, '873 does not teach providing in-situ spray cleaning of Excimer LASER processed substrates and does not provide a means for integrating cryogenic spray cleaning into the LASER production process.

The failure in the prior art to effectively provide a technology capable of operating within the production process, the same workcell or process tool to provide clean-in-place capability results in a number of disadvantages and limitations in manufacturing operations. As discussed herein, overall productivity is limited by many factors including environmental control challenges for cryogenic spray cleaning, carbon dioxide cleaning machine's ability to operated autonomously, adaptability to different manufacturing processes and tools, cleaning complex surfaces, and cleaning multiple surfaces at one time.

This is particularly disadvantageous in flexible manufacturing systems in which the entire machining operation is intended to be completely automated. Flexible manufacturing systems are designed to operate without human assistance, or greatly reduced human assistance, and it substantially limits their efficiency if a worker must regularly remove substrates, clean them and return them to the manufacturing tool or line.

In another invention by the present inventor, U.S. Pat. No. 5,725,154, the use of a coaxial solid spray generator to spray clean critical surfaces is taught. The '154 invention suffers from the same limitations of other prior art discussed herein including the need for environmental control as well as the need for utilitarian improvements necessary for integration into and control by a production tool. For example, significant improvements in the present invention over '154 include a gas-to-liquid phase condenser and purification system which allows the present invention to be used anywhere in the manufacturing environment with just a single source supply of carbon dioxide gas. This is a particular advantage in manufacturing environments where the transport or storage of high pressure liquid carbon dioxide supply tanks would be cumbersome or pose a risk to workers. Moreover, gas supply lines may be brought from a single supply tank to multiple production tools incorporating the present invention.

Moreover, a new type of capillary condenser technology is taught herein called a "stepped capillary condenser", which achieves solid carbon dioxide particle types (i.e., particle size and coarseness) heretofore not possible using '154. Conventional snow cleaning devices produce fine gas-filled solid particles, of which a significant quantity of particles are needed to efficiently clean a surface. Moreover, fine particles require extremely high velocities to dislodge tenacious surface contaminants. By contrast, the more coarse particles generated by the stepped capillary condenser embodiment of present invention provide increased physicochemical cleaning action and fewer of these types of particles required to remove very tenacious surface residues.

Still moreover, further research by the present inventor has shown that oscillating the snow particle stream at greater than 1 Hertz significantly improves surface cleaning action (i.e., scouring) with the added benefit of not interrupting the generation and flow of solid carbon dioxide particles. Finally, a means for multiplexing coaxial spray applicators is taught, which provides a method for cleaning multiple sides of a complex article.

Unlike the prior art, the present invention provides the ability to seamlessly integrate cryogenic spray cleaning into a production process. There are many manufacturing applications where such a capability as in the present invention would improve quality and performance, provide a lower cost of ownership and longer tool life (i.e., cutting and dicing blades), smaller footprint, less cleanroom floor space, and provide an increase in process efficiency. One such example is described as follows.

The growing variety and complexity of matrix array packages present a true challenge to many back end processes. The singulation (i.e., dicing a wafer into discrete dies) of these arrays into individual packages is an important step in the manufacturing process, and as in many cases, needs to be optimized to minimize the overall cost of package. The continuous reduction in package size, along with the demand for increased throughput has resulted in a shift to advanced dicing processes for many matrix array packages, for example copper-ceramic and copper-plastic packages. Quality issues associated with conventional dicing of such devices using water-based coolant include chipping along the edges of the diced kerf, smearing of the ductile copper, and the formation of burrs. Using the selective impingement cleaning apparatus of the present invention, a dicing-cleaning hybrid system improves cutting quality, reduces chipping, reduces smearing and burr formation. Another advantage is increased tool life as well since the tool itself is continuously cleaned during the process.

Today's production environment demands fairly autonomous operation and standard control and communication between production controls and equipment to improve efficiency, increase quality and reduce manufacturing costs. These so-called plug and play manufacturing tools utilize standards such as the Generic Model for Communications and Control of Semi Equipment, the Semiconductor GEM standard. No prior art teaches a module which combines all the necessary elements for efficient use of solid phase carbon dioxide spray cleaning in production tools and on the manufacturing line.

As such there is a present need for a plug and play process, apparatus and chemistry that reduces air pollution, eliminates worker exposure hazards, eliminates liquid hazardous waste production, and enables the widespread implementation of in-situ precision cleaning or more specifically clean-during-processing capability.

In many manufacturing operations a product is cleaned prior to or following a particular assembly process, sometimes many times through the production cycle. Conventional parts cleaning operations are performed as an independent operation prior to or following a manufacturing process using, for example, a spray cleaner, vapor degreaser or ultrasonic cleaning system. Segregation of the cleaning process has been due to the inherent chemical and physical incompatibilities between conventional cleaning operations and most assembly tools. Manufacturing operations requiring a cleaning or surface treatment process may include cutting, drilling, trimming, micro-machining, bonding, dicing, abrasive finishing, polishing, stamping and welding, among many other operations. There is a present need for an alternative cleaning model for the manufacturing process. This alternative integrated cleaning into the production process to produce a range of new assembly tools—hybridized cleaning and manufacturing tools. Hybrid tools are much more productive because two or more assembly processes can be performed simultaneously within the same work cell. Substrates being treated don't have to be removed, cleaned and returned to the production line—resulting in reduced human interaction, higher throughput and decreased cost-of-ownership. In the traditional manufacturing model, precision parts cleaning is not considered a value-added operation. The present invention incorporates the cleaning process into the value-added assembly and manufacturing operations, which enhances both product yield and tool productivity. The present invention is suitable for integration into original equipment manufacturer (OEM) tools as well as serving as a stand-alone tool for manufacturing production lines. The present invention enables the creation of unique and useful hybrid manufacturing technology, providing cleaning during manufacturing and assembly operations.

BRIEF SUMMARY OF INVENTION

The carbon dioxide snow apparatus of the present invention generally includes a snow generation subsystem and a diluent or propellant subsystem connected to a delivery line and applicator. The snow generation subsystem includes a stepped capillary condenser comprising at least two connected segments of differing diameters. The stepped capillary condenser provides increased Joule-Thompson cooling in the conversion of liquid carbon dioxide to solid carbon dioxide, reduces clogging and sputtering, improves jetting, and allows for greater spray temperature control. Moreover, the stepped capillary condenser produces coarser particles than a single step capillary.

Another aspect of the present invention is the ability to provide several snow generation subsystems, each with a stepped capillary condenser, in communication with a single carbon dioxide source and diluent or propellant subsystem. This allows for the generation of snow particles of differing sizes and physical qualities to fit the need of treating a single substrate or multiple substrates. The several snow generation subsystems, diluent or propellant subsystem and respective delivery lines and applicators can be independently controlled and fitted within a console or mobile unit.

DETAILED DESCRIPTION

Figure 1:
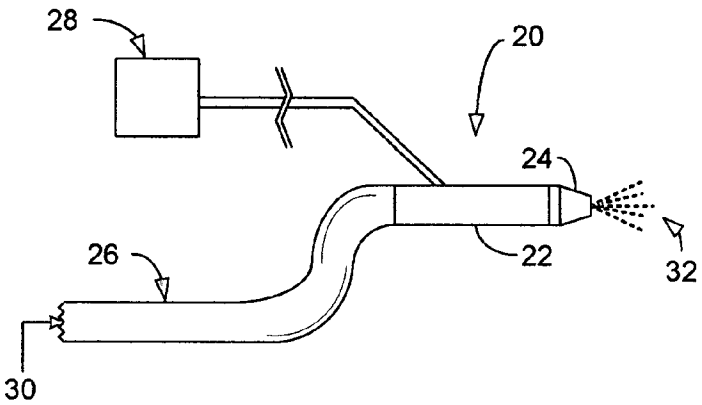
FIG. 1 is an illustrated perspective view of a carbon dioxide snow treatment apparatus of the present invention.

A carbon dioxide snow treatment apparatus for selectively treating a substrate within a manufacturing process is generally indicated at 20 in FIG. 1. The apparatus 20 includes a dense fluid spray applicator 22, with a mixing spray nozzle 24, connected to a flexible capillary condenser 26. Preferably, the dense fluid spray applicator 22, used in conjunction with a connected propellant gas source, is either a co-axial dense fluid spray applicator as taught by the present inventor and fully disclosed in U.S. Pat. No. 5,725,154 or a tri-axial type delivering apparatus as taught by the present inventor and fully disclosed in U.S. Provisional Application No. 60/726,466, both of which are hereby incorporated herein by reference. Employing either fluid spray applicator 22, a dense fluid 30, preferably liquid carbon dioxide, enters the capillary condenser 26 whereupon passing therethrough, or in conjunction with the applicator 22, is condensed and solid carbon dioxide snow 32 exits the mixing spray nozzle along with the propellant gas 28 or any uncondensed carbon dioxide.

Figure 2:
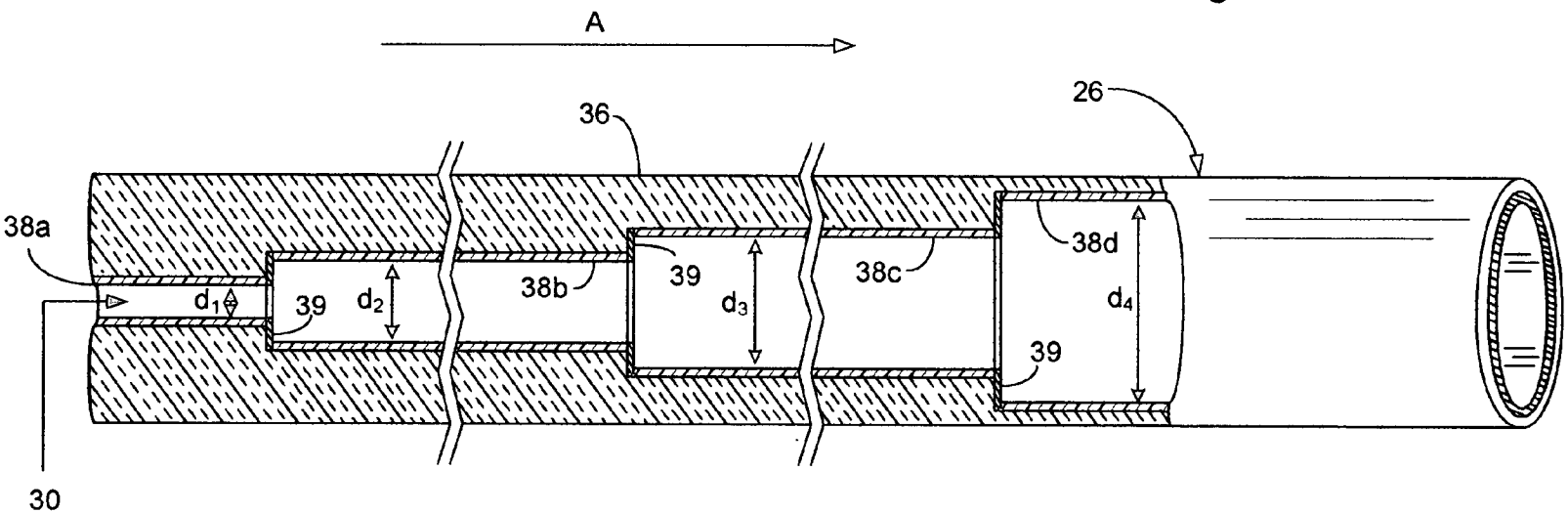
FIG. 2 is a partial cross sectional view of the carbon dioxide snow treatment apparatus of FIG. 1.

Referring to FIG. 2, the capillary condenser 26 includes a capillary tube 34 covered by suitable insulation 36, such as for example, 0.318 cm (0.125 inch) of self-adhering polyurethane insulation foam tape as supplied by Armstrong World Industries, Inc. of Lancaster, Pa., which is wrapped about the capillary tube 34 in a helical fashion with 50% overlap. The capillary tube 34 includes segmented capillaries 38 that have step-wise increasing diameters, indicated by $d_1$, $d_2$, $d_3$ and $d_4$, respectively, which increase in a feed-wise direction, indicated by arrow A. Thus, $d_1<d_2<d_3<d_4$. It should be noted, though, that capillary tube 34 of FIG. 2 is for illustrative purposes only, and that the capillary tube 34 of the present invention need only include at least two segments 38, and it is well within the scope of the present invention to provide a capillary tube 34 with three or more segments 38 as well, depending upon the particular application. The capillary 34 is preferably constructed of a PolyEtherEtherKetone (PEEK) polymer. However, other suitable tubular materials are well within the scope of the present invention including, but not limited to, Teflon®, Stainless Steel, or other clean and flexible materials. As stated, the capillary condenser tube 34 includes at least two segments 38, with each segment 38 preferably having a length ranging from 0.3 m (1 foot) to 7.32 m (24 feet) and inside diameters ranging from 0.127 mm (0.005 inches) to 3.175 mm (0.125 inches). Such tubing should be able to withstand propellant gas pressures ranging up to about 7 MPa (1000 psi) and temperatures ranging between 203 K and 473 K. The interconnections 39 between the segments may be Swagelok or finger-tight compression fittings.

Figure 3:
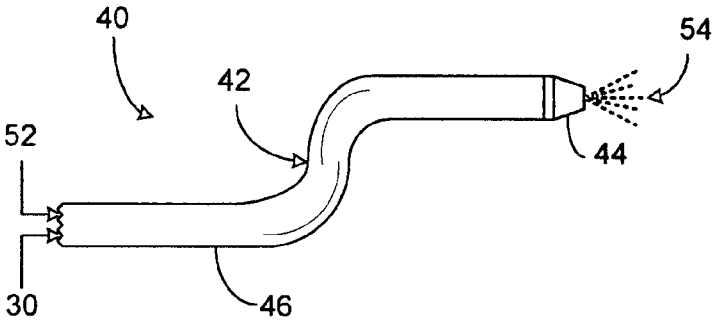
FIG. 3 is an illustrated perspective view of an alternative embodiment of a snow treatment apparatus of the present invention.
Figure 4:
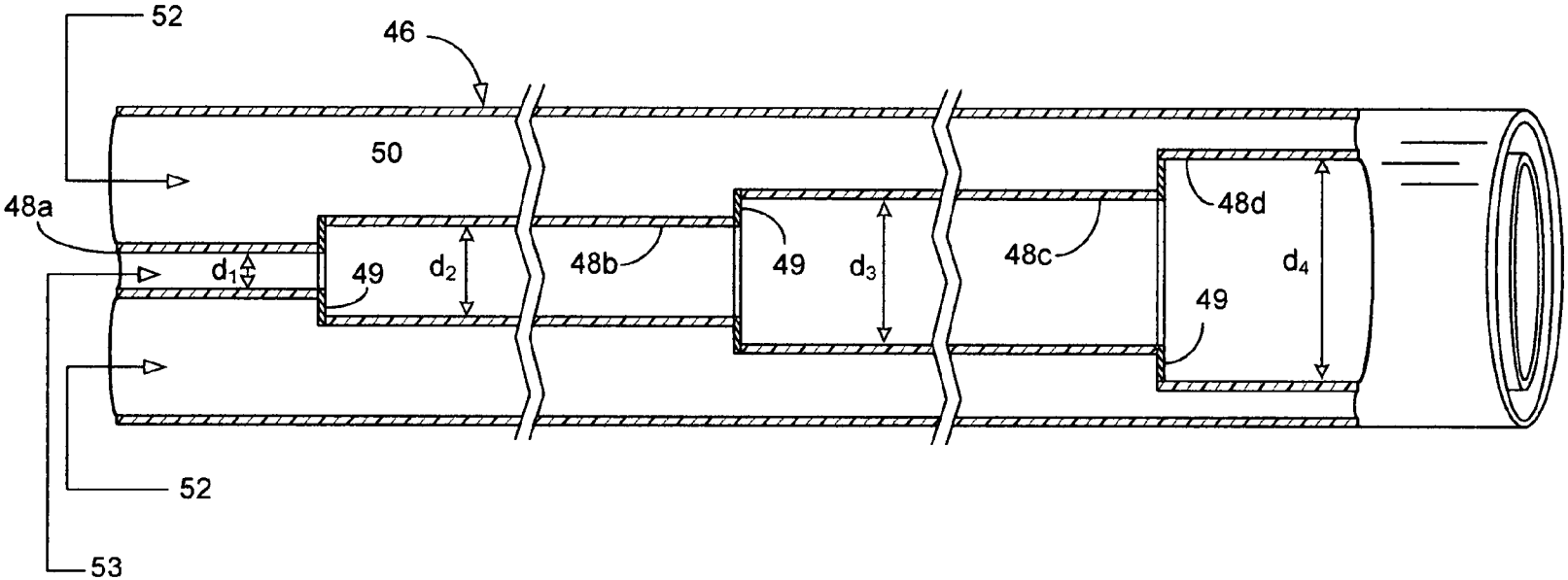
FIG. 4 is a partial cross sectional view of the alternative embodiment of a snow treatment apparatus of FIG. 3.

FIGS. 3 and 4 illustrate an alternative carbon dioxide snow treatment apparatus 40 of the present invention including a flexible capillary condenser 42 connected to a divergent/convergent nozzle 44. The capillary condenser 42 similarly includes a capillary tube 46 having segmented capillaries 48*a*, 48*b*, 48*c* and 48*d* that have step-wise increasing diameters $d_1$, $d_2$, $d_3$ and $d_4$, respectively, which increase in a feed-wise direction, indicated by arrow B. The capillary 42 is preferably constructed of PEEK polymer. However, other suitable tubular materials are well within the scope of the present invention including, but not limited to, Teflon®, Stainless Steel, or other clean and flexible materials. As stated, the capillary condenser tube 42 includes at least two segments 48, with each segment 48 preferably having a length ranging from 0.3 m (I foot) to 7.32 m (24 feet) and inside diameters ranging from 0.127 mm (0.005 inches) to 3.175 mm (0.125 inches). Such tubing should be able to withstand propellant gas pressures ranging up to about 7 MPa (1000 psi) and temperatures ranging between 203 K and 473 K. The interconnections 49 between the segments may be Swagelok or finger-tight compression fittings. The capillary tube 42 is positioned within a propellant gas tube 50. A heated propellant gas 52 is carried within the flexible propellant delivery tube 50 to the nozzle 44. The propellant tubing 50 may be constructed of any number of suitable tubular materials including Teflon, Stainless Steel overbraided Teflon®, Polyurethane, Nylon, among other clean and flexible materials having lengths ranging from 0.3 cm (1 foot) to 7.3 m (24 feet) or more and inside diameters ranging from about 0.65 cm (0.25 inches) to about 1.3 cm (0.50 inches). Such tubing 46 should be able to withstand propellant gas pressures ranging between about 0.07 MPa (10 psi) and 1.72 MPa (250 psi) and temperatures ranging between 293 K and 473 K. The exemplary flexible condenser 42 of the alternative embodiment 40 is terminated with the rigid mixing spray nozzle 44 which contains a convergent mixing nozzle portion and a divergent expansion nozzle portion (not shown) as is known in the art. Dense fluid 53, preferably liquid carbon dioxide, enters the capillary assembly 46 and forms carbon dioxide snow particles as the carbon dioxide progresses through the at least two capillary segments 48. Upon entering the nozzle 44, carbon dioxide snow particles discharge from the capillary condenser assembly 46, mixing with propellant gas 52 discharged from the propellant aerosol tube 50, thus forming a solid-gas carbon dioxide spray 54. The carbon dioxide aerosol spray 54 discharges from the nozzle 44 and is selectively directed at a substrate surface (not shown).

Being that both embodiments 20 and 40 include similar stepped capillary assemblies 34 and 46, respectively, reference to one shall include reference to the other and all their like parts, for purposes of convenience, unless stated otherwise. Capillary segments 38 are constructed to have increasing, or stepped, diameters in the direction of flow because it has been discovered that by providing stepped capillaries of increasing diameter, certain performance advantages over single capillary diameters are resulted. For instance, when employing carbon dioxide as the dense fluid, larger and harder snow particles can be generated from a relatively smaller feed supply of carbon dioxide. Also, starting with an internal capillary diameter as little as about 0.5 mm (0.020 inches) in the first capillary segment, restricted flow into and down the capillary condenser tube is resulted. It has also been discovered that by manipulating the number of steps and incrementally increasing the capillary step diameters, various ranges of solid phase particle size distribution can be produced. Stepped capillary condensation more efficiently condenses the liquid and vapor to solid through sharp near-isobaric expansion cooling while also producing a more desirable range of impact shear stresses.

Figure 5:
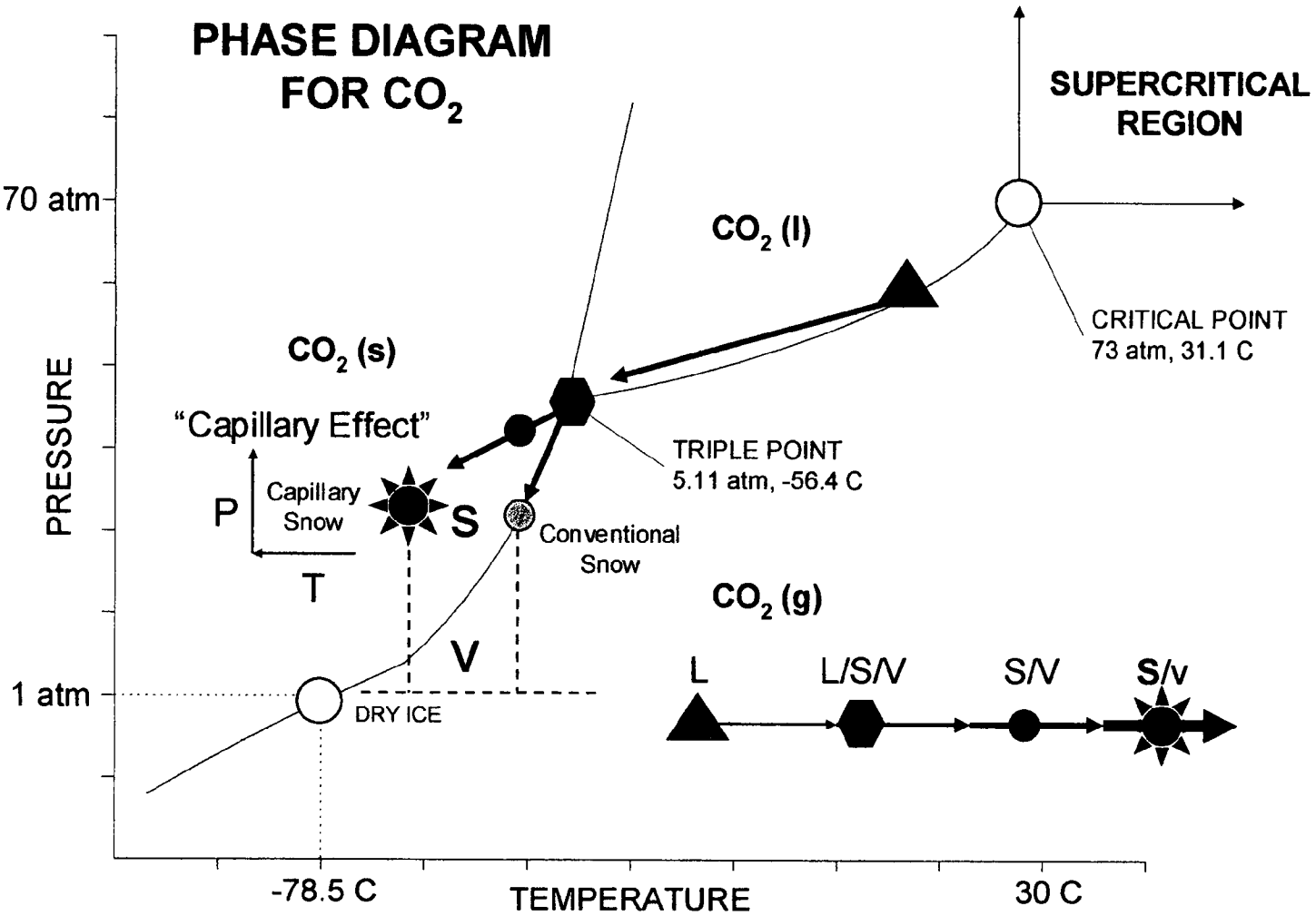
FIG. 5 is a phase diagram of carbon dioxide.

Referring to FIG. 5, using a non-stepped capillary, liquid carbon dioxide at approximately 6 MPa (60 atmospheres) and 293 K enters the capillary condenser 26 and begins to boil at the triple point. Pressure builds instantly within the condenser causing the boiling mixture to subcool below the triple point, traversing deeply into the solid phase region. Temperature continues to decrease within the capillary while pressure is maintained at a pressure above the vapor phase. This capillary effect is an optimized Joule-Thompson process which efficiently produces an aerosol composition rich in solid phase carbon dioxide.

Figure 6:
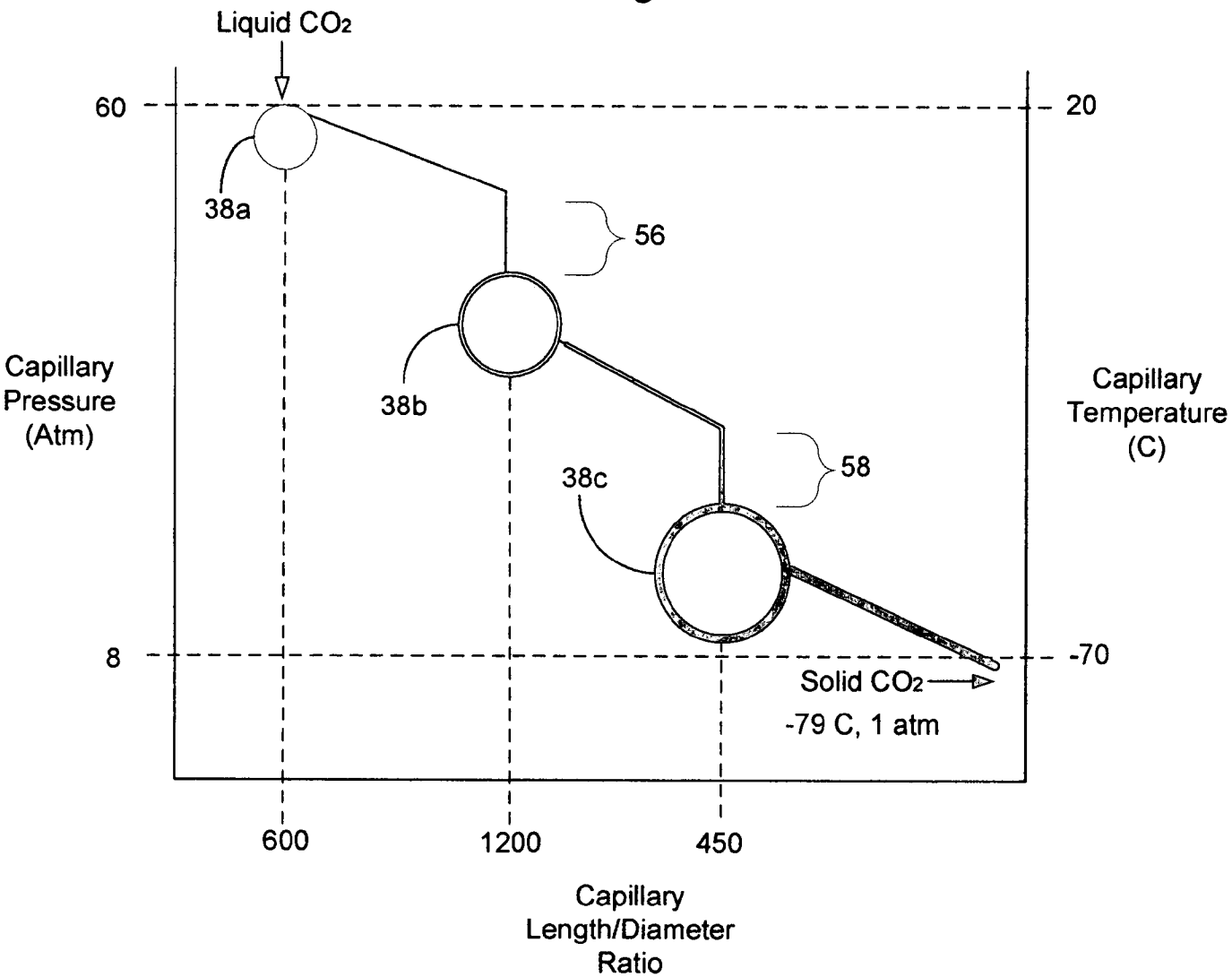
FIG. 6 is a graphical diagram of the physical characteristics of a stepped capillary condenser of the present invention.

Referring now to FIG. 6, liquid carbon dioxide enters the first segment 38*a* of the stepped capillary condenser 34 of the present invention. The liquid carbon dioxide almost instantly pressurizes the entire capillary tube 34 with a mixture of sub-cooled gas, solids and liquid. The pressure within the capillary condenser 34 builds rapidly causing the gas phase to re-condense to solid phase and/or liquid phase. After traversing the first capillary segment 38*a*, the mixture encounters a sharp step in the second capillary segment 38*b* which increases the expansion volume considerably. This sharp change in volume causes the mixture temperature to drop rapidly 56 to near-isobaric expansion, forming relatively coarse and large crystals of solid phase carbon dioxide. The mixture continues to condense along the second capillary segment until encountering the third capillary segment 38*c*, again rapidly expanding and cooling 58 the mixture to form additional coarse crystals of solid phase carbon dioxide. The mixture continues to condense in further segments 38*d* and so on.

By contrast, conventional snow spray processes using less efficient Joule-Thompson condensation means, such as expansion upon exiting a spray nozzle, do not build pressure or lower temperature along a progressive gradient. The mixture thus exists for a very short time along the solid-vapor line which produces snow composition having as much as 30% to 40% less solid phase produced from the liquid phase, and much more vapor phase.

Figure 7:
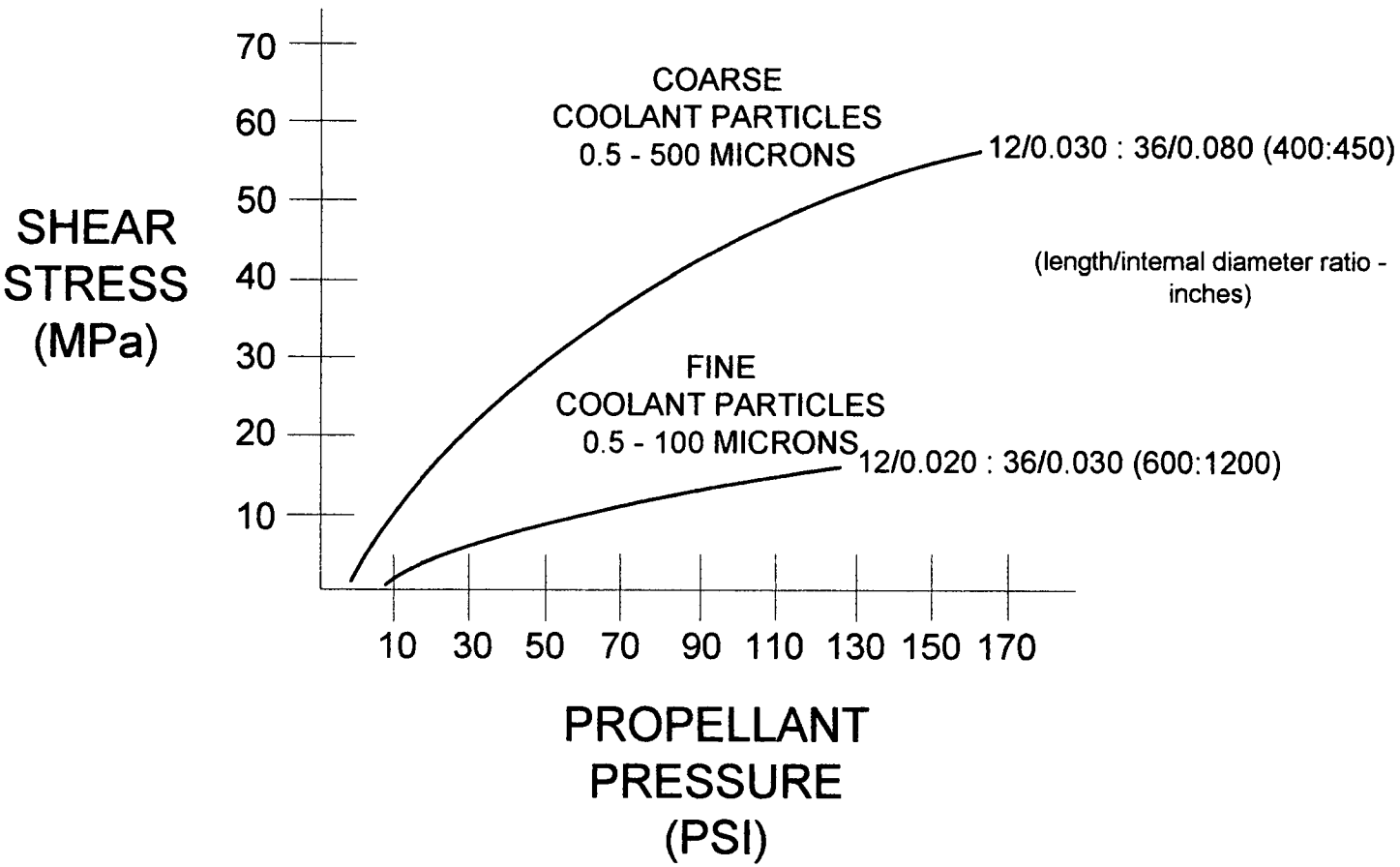
FIG. 7 is a graphical diagram of shear impact stresses of the present invention.

Another aspect of providing a stepped capillary condenser 34 is the ability to optimize spray composition 32 with respect to snow particle size distribution. This is important because the cleaning energy, defined by the force, pressure and stress of the snow particle directed onto the substrate, is directly proportional to the size or mass of the snow particle. Referring to FIG. 7, a stepped capillary condenser comprising a 30 cm (12 inch) long section of 0.8/1.6 mm (0.030/0.0625 inch) inside/outside diameter PEEK capillary segment coupled with a 91 cm (36 inch) long section of 2.0/3.2 mm (0.080/0.125 inch) inside/outside diameter PEEK capillary tube produces variable shear stress pressures of between 0 and 50 MPa for propellant pressures of between 0 and 1 MPa (150 psi). By contrast, the stepped capillary condenser of the present invention comprising a 30 cm (12 inch long) section of 0.5/1.6 mm (0.020/0.0625 inch) inside/outside diameter PEEK capillary segment coupled with a 91 cm (36 inch) long section of 0.8/1.6 mm (0.030/0.0625 inch) inside diameter PEEK capillary segment produces variable shear stress pressures of between 0 and 10 MPa for propellant pressures of between 0 and 0.9 MPa (130 psi). It can be seen that for an approximate doubling of the capillary step volume, for a given capillary condenser length, propellant pressure and temperature, a five-fold increase in shear stress pressure can be exerted. In accordance with the following equation:

$$\text{Kinetic Energy} = \tfrac{1}{2}(\text{Mass})(\text{Velocity})^2$$

the solid carbon dioxide particles impacting the surface appear to have a particle size distribution having about a five-fold difference. Spray impact stress experiments performed using Prescale Series contact pressure measuring films, manufactured by FujiFilm USA, show that spray impact pressures may be selectively altered using stepped capillary condensers 34 to produce a mass of sublimable particles and coupling the particle stream with a propellant phase. The present invention can produce solid carbon dioxide particles having diameters ranging 0.5 microns (fine) to 500 microns (coarse) which are able to produce variable impact stresses. A fine particle spray can produce a range of impact stresses from less than 0.1 MPa to approximately 15 MPa at propellant phase pressures of between 0 and 1 MPa. A coarse particle spray can produce a range of impact stresses from less than 0.1 MPa to approximately 50 MPa at propellant phase pressures of between 0 and 1 MPa. Higher impact stresses are imparted at higher propellant pressures and lower impact stresses are imparted at lower propellant pressures. Propellant pressure and temperature can be used selectively to alter both the impact stress and impact particle density.

A preferred capillary combination 34 for use with the present invention includes a 31 cm (12 inches) of 4.2/0.3 mm (0.010/0.167 inch) inside/outside diameter capillary coupled with a 46 cm (18 inches) of 0.5/1.6 mm (0.020/0.062 inch) inside/outside diameter capillary and a 91 cm (36 inches) of 1.0/1.6 mm (0.040/0.062 inch) inside/outside diameter PEEK capillary. The initial 61 cm (24 inch) section of the capillary condenser is wrapped up, while the third segment is run down the coaxial propellant tube 46 to form the coaxial spray applicator 44. A more preferred capillary combination 34 for use with the present invention includes the first capillary segment 38*a* comprising approximately 31 cm (12 inches) of 0.76 mm (0.030 inch) inside diameter PEEK, followed by the second capillary segment 38*b* being approximately 92 cm (36 inches) to 122 cm (48 inches) of 2 mm (0.080 inch) inside diameter PEEK tubing. The entire PEEK stepped capillary assembly 34, with the exception of the portion traversing the coaxial line 50, is wrapped in insulating material 36 to prevent heat transfer during the condensation process. Other lengths, diameters and stepwise constructions are possible to form various desired spray compositions therein.

Alternatively, the dense fluid composition is that as taught by the present inventor and fully disclosed in U.S. application Ser. No. 11/301,466 entitled CRYOGENIC FLUID COMPOSITION filed concurrently herewith and claiming benefit from U.S. Provisional Application No. 60/635,399, both of which are hereby incorporated by reference.

Figure 8:
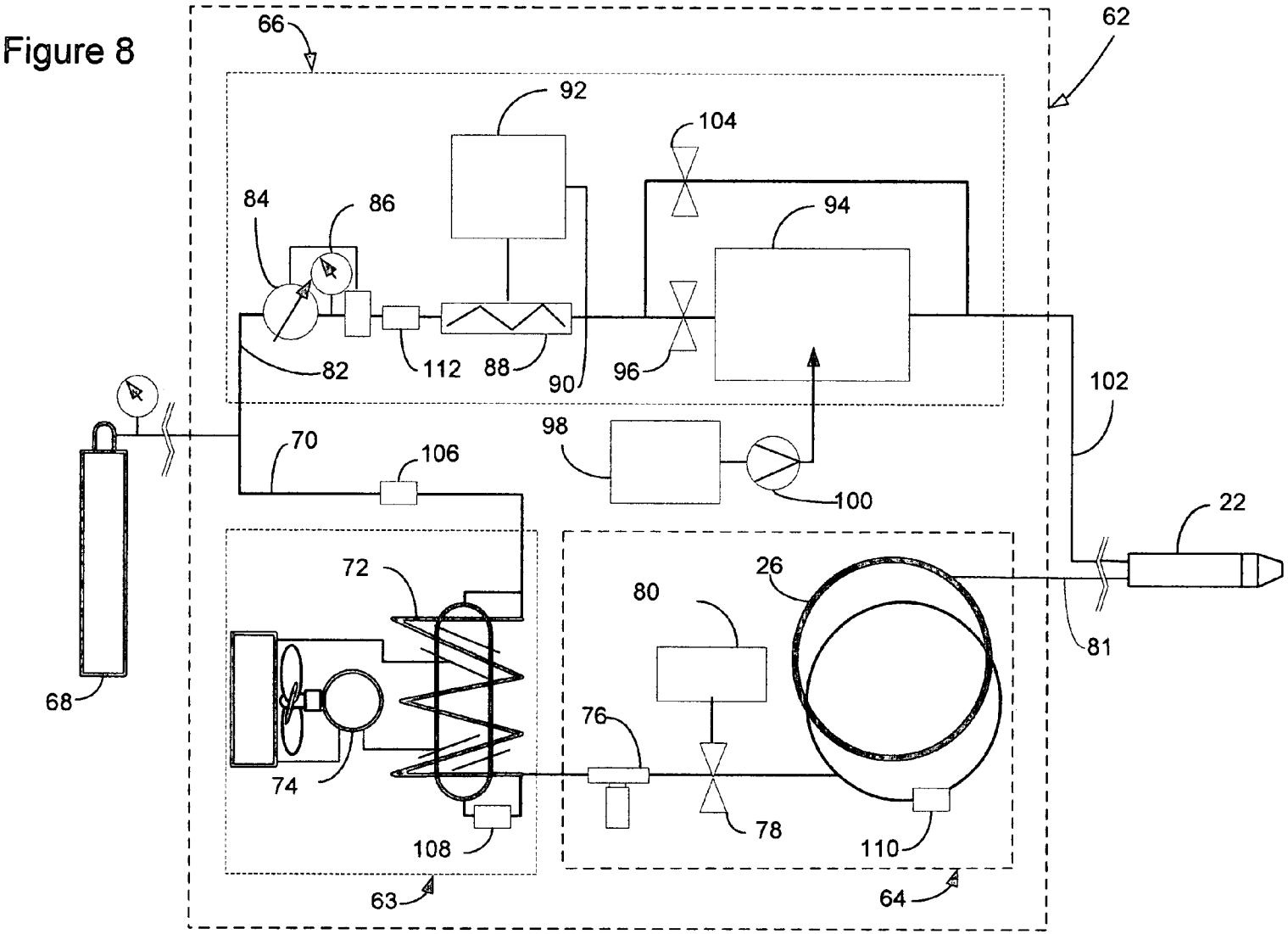
FIG. 8 is a flow-diagram of a carbon dioxide snow treatment system of the present invention.

Having thus described the preferred method for generating carbon dioxide snow particles within a stepped-capillary condenser 34, the following is a discussion of exemplary apparatuses for creating a stepped capillary condenser 26 in a carbon dioxide snow treatment system. Referring to FIG. 8, a carbon dioxide snow treatment system is indicated at 62 and includes carbon dioxide liquification subsystem 63, a carbon dioxide snow generation subsystem 64 and the carbon dioxide propellant aerosol generation subsystem 66 connected to a high-pressure carbon dioxide supply 68. The high pressure carbon dioxide gas 68 preferably has a pressure range of between 2 MPa (300 psi) and 6 MPa (900 psi). The carbon dioxide snow generation subsystem 64 and propellant aerosol subsystem 66 are each connected to a dense fluid spray applicator.

The high pressure carbon dioxide gas is fed into the liquification subsystem 63 via a pipe 70 to a tube-in-tube heat exchanger 72, wherein a compressor-refrigeration unit 74 re-circulates sub-cooled refrigerant countercurrent with the heat exchanger 72, condensing the carbon dioxide gas into a liquid carbon dioxide base stock. Liquid carbon dioxide base stock flows from the heat exchanger 72 into the snow generation subsystem 64 through a micro-metering valve 76, a base cleaning stock supply ball valve 78 and then into the stepped capillary condenser unit 26. Optionally, a supply ball valve 78 may be oscillated between opened and closed at a cycle rate of one or more cycles per second using an electronic pulsing timer 80. In the present embodiment, the stepped capillary condenser 26 is constructed first using a 61 cm (24 inch) segment of 0.8/1.6 mm (0.030/0.0625) inside/outside diameter PEEK tubing and then a second 91 mm (36 inch) segment of 1.5/3.2 mm (0.060/0.125 inch) inside/outside diameter PEEK tubing. As described, the stepped capillary condenser 26 boils liquid carbon dioxide base stock under a controlled pressure gradient to produce a solid phase carbon dioxide base stock which is fed to the applicator 22 via delivery line 81.

In the propellant generation subsystem 66, the high pressure carbon dioxide gas 68 is therein via a pipe 82 and into a pressure reducing regulator 84 and gauge 86 capable of regulating the carbon dioxide gas propellant pressure between 0.07 MPa (10 psi) and 1.72 MPa (250 psi) or more. The regulated carbon dioxide gas is then fed into a resistance heater 88 controlled by a thermocouple 90 and temperature controller 92 at a temperature between 293 K and 473 K. Following this, temperature-controlled carbon dioxide gas is fed into either the spray applicator 22 or into an aerosol generator 94. When employing the aerosol generator 94, temperature-regulated carbon dioxide propellant is fed via an aerosol generator inlet valve 96 into the aerosol generator 94. The aerosol generator 94 is supplied by a additive supply tank 98 and injection pump 100 which can inject cleaning additives, such as acetone, into the temperature-regulated carbon dioxide propellant gas preferably at a rate of between 0 liters per minute and 0.02 liters per minute or more, thus forming a temperature-regulated carbon dioxide propellant aerosol which may be fed into a propellant aerosol feed line 102. Alternatively, temperature-regulated carbon dioxide propellant gas may be fed via an aerosol generator bypass valve 104, thus by-passing the aerosol generator 94, and connecting directly into the propellant aerosol feed line 102. It should be noted, though, that pressure-regulated clean dry compressed air (CDA) or nitrogen gas may be used in place of pressure-regulated carbon dioxide gas on piping connection 82 described above to produce a propellant aerosol stream supply.

Another aspect of the carbon dioxide treatment system 62 is that a means is provided for monitoring and controlling the operation of each subsystem 64 and 66. Such process intelligence is accomplished by using various pressure and temperature sensors along strategic points within each subsystem 64 and 66. To accomplish this, a pressure switch or transducer 106 is used to measure the input $CO_2$ pressure to provide and on/off signal with respect to the carbon dioxide gas supply 98. A thermocouple or thermometer 108 is used within the condenser coil 72 to determine if the carbon dioxide gas is being condensed to liquid. Finally, a thermocouple or thermometer 110 is employed within the stepped capillary condenser assembly 26 to determine if the liquid carbon dioxide is being converted from liquid carbon dioxide to the solid phase. Table 1 lists the preferable operating range parameters for the solid carbon dioxide subsystem 64.

TABLE 1

Exemplary Solid $CO_2$ System Sensors and Operating Ranges

| Sensor | Lower Limit | Upper Limit |
|---|---|---|
| Pressure Sensor 106 | 2 MPa (300 psi) | 6 MPa (850 psi) |
| Temperature Sensor 108 | 273 K | 283 K |
| Temperature Sensor 110 | 213 K | 253 K |

Referring now to the propellant supply subsystem 66, a pressure switch or transducer 112 is used to measure the regulated carbon dioxide (or CDA) pressure to provide an on/off signal with respect to the propellant gas supply 68. Finally, the thermocouple or thermometer 90 is used with the propellant heater 88 and temperature controller 92 to determine if the carbon dioxide (or CDA) propellant gas is being heated to a proper operating temperature. Table 2 lists the preferred operating range parameters for the propellant subsystem 66

TABLE 2

Exemplary Propellant Gas System Sensors and Operating Ranges

| Sensor | Lower Limit | Upper Limit |
|---|---|---|
| Pressure Sensor 112 | 207 kPa (30 psi) | 1.7 MPa (250 psi) |
| Temperature Sensor 90 | 293 K | 473 K |

Figure 9:
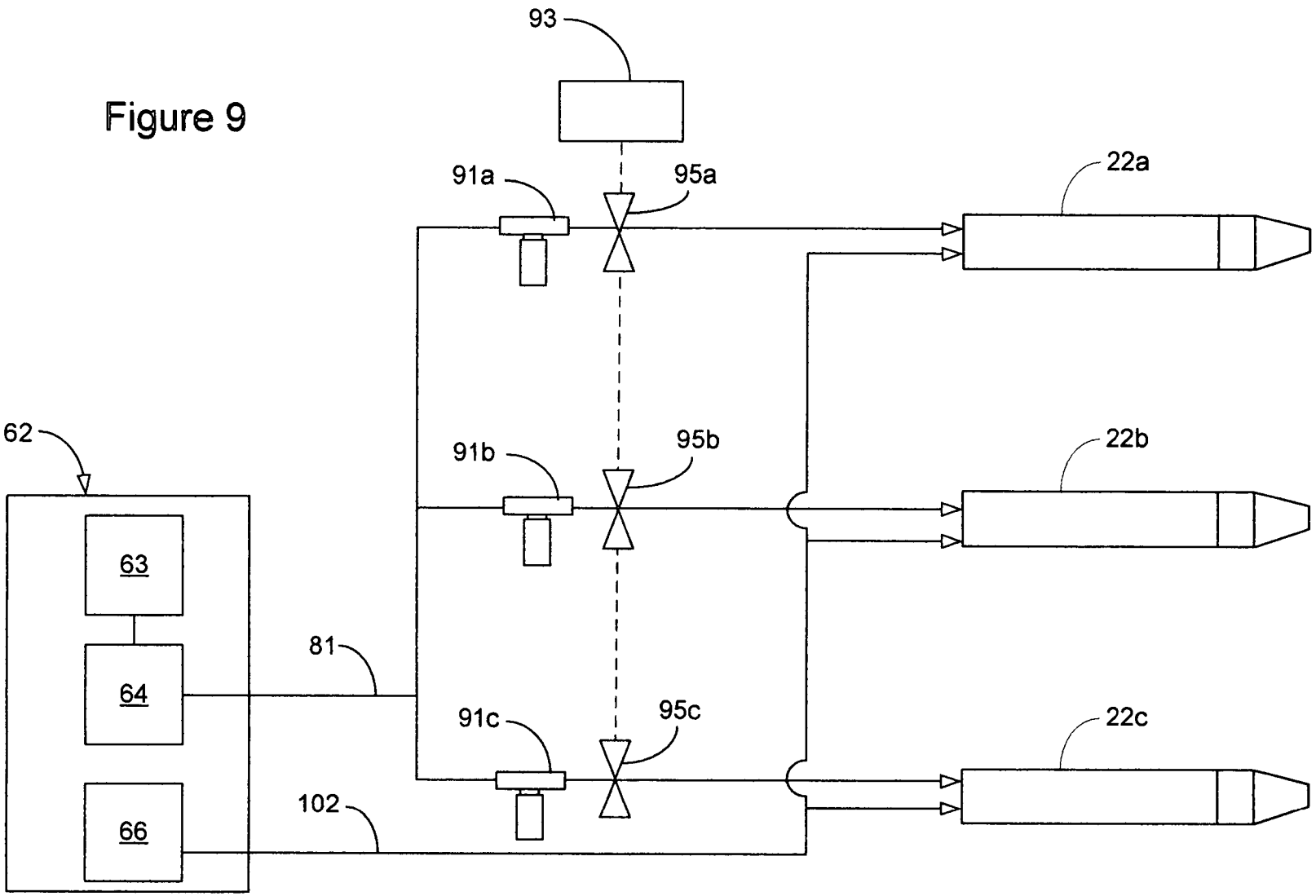
FIG. 9 is a flow-diagram of an alternative embodiment of the carbon dioxide snow treatment system of the present invention.
Figure 10:
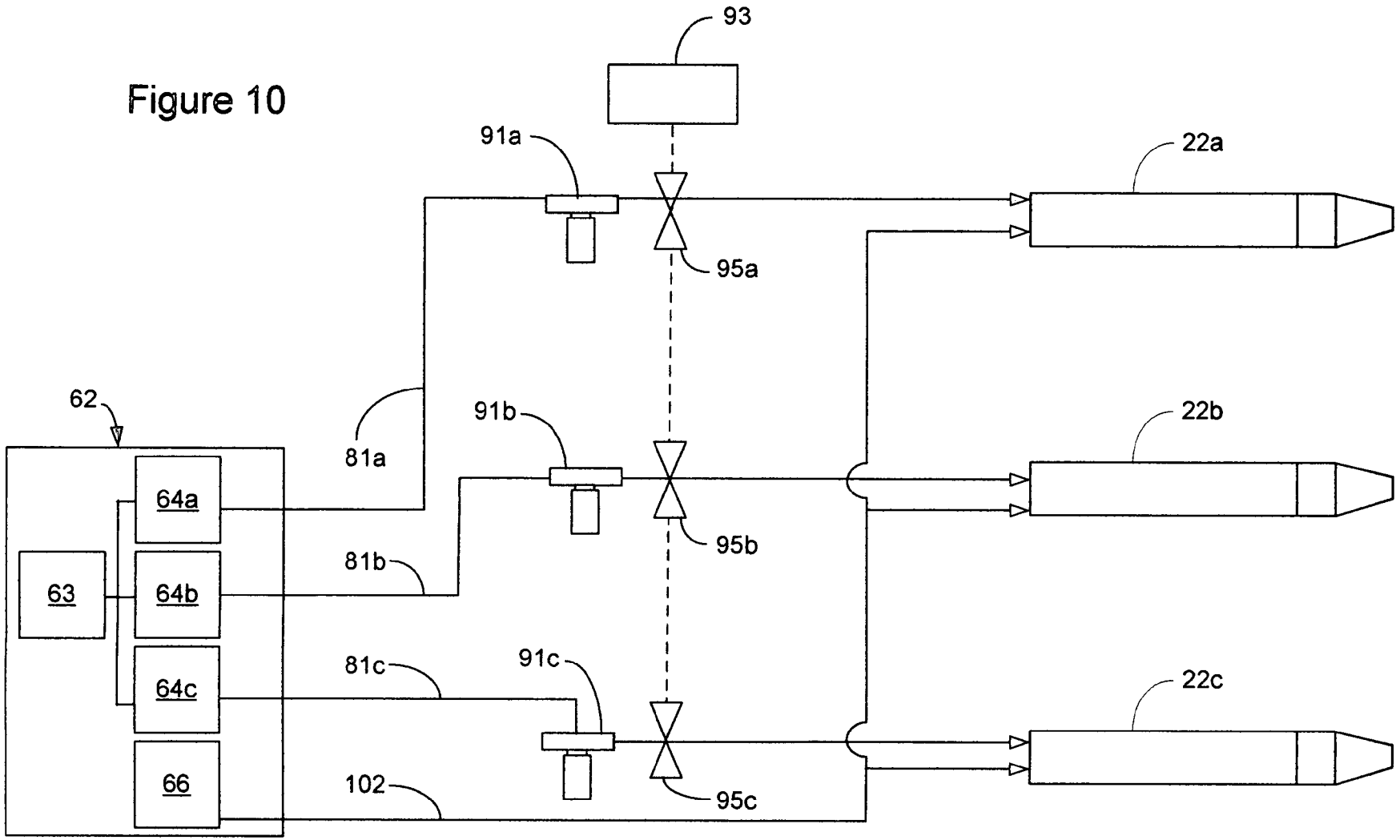
FIG. 10 is a flow-diagram of an alternative embodiment of the carbon dioxide snow treatment system of the present invention.

Industrial cleaning or surface treatment applications may require multiple treatment spots on a substrate or multiple treatment spots in close proximity. Any desired number of independent carbon dioxide snow treatment applicators 22 may be provided by multiplexing each applicator 22 with the carbon dioxide snow treatment system 62. Referring to FIG. 9, the carbon dioxide snow treatment system 62 is connected, for exemplary purposes, to three carbon dioxide snow applicators 22*a*, 22*b* and 22*c*, respectively. Carbon dioxide snow is fed from the carbon dioxide generation subsystem 64 via delivery line 81 to respective discrete lines 81*a*, 81*b* and 81*c*. Respective discrete line control valves 91*a*, 91*b* and 91*c* control the flow rate of the carbon dioxide snow into the respective applicator 21*a*, 21*b* and 21*c*. Optionally, a pulse generator 93 operatively connects to respective ball valves 95*a*, 95*b* and 95*c* to oscillate each ball valve 95*a*, 95*b* and 95*c* between opened and closed at a cycle rate of one or more cycles per second. Likewise, propellant from propellant subsystem 66 is fed via delivery line 102 to each of the discrete spray applicators 22*a*, 22*b* and 22*c*. Alternatively, and as illustrated in FIG. 10, if varying particle sizes of carbon dioxide snow is simultaneously desired for a single or multiple applications, the carbon dioxide snow system 62 can be modified to include several snow generation subsystems 64*a*, 64*b* and 64*c*. Each subsystem 64*a*, 64*b* and 64*c* is independently controlled and connected to the corresponding spray applicator 22*a*, 22*b* and 22*c*, respectively, via corresponding snow delivery line 81*a*, 81*b* and 81*c*, respectively. Flow rates for each line are again controlled by corresponding control valves 91*a*, 91*b* and 91*c*, respectively, along with pulse generator 93 and corresponding ball valves 95*a*, 95*b* and 95*c*. Propellant line 102 again connects the propellant generation subsystem 66 to each spray applicator 22*a*, 22*b* and 22*c*.

Figure 11:
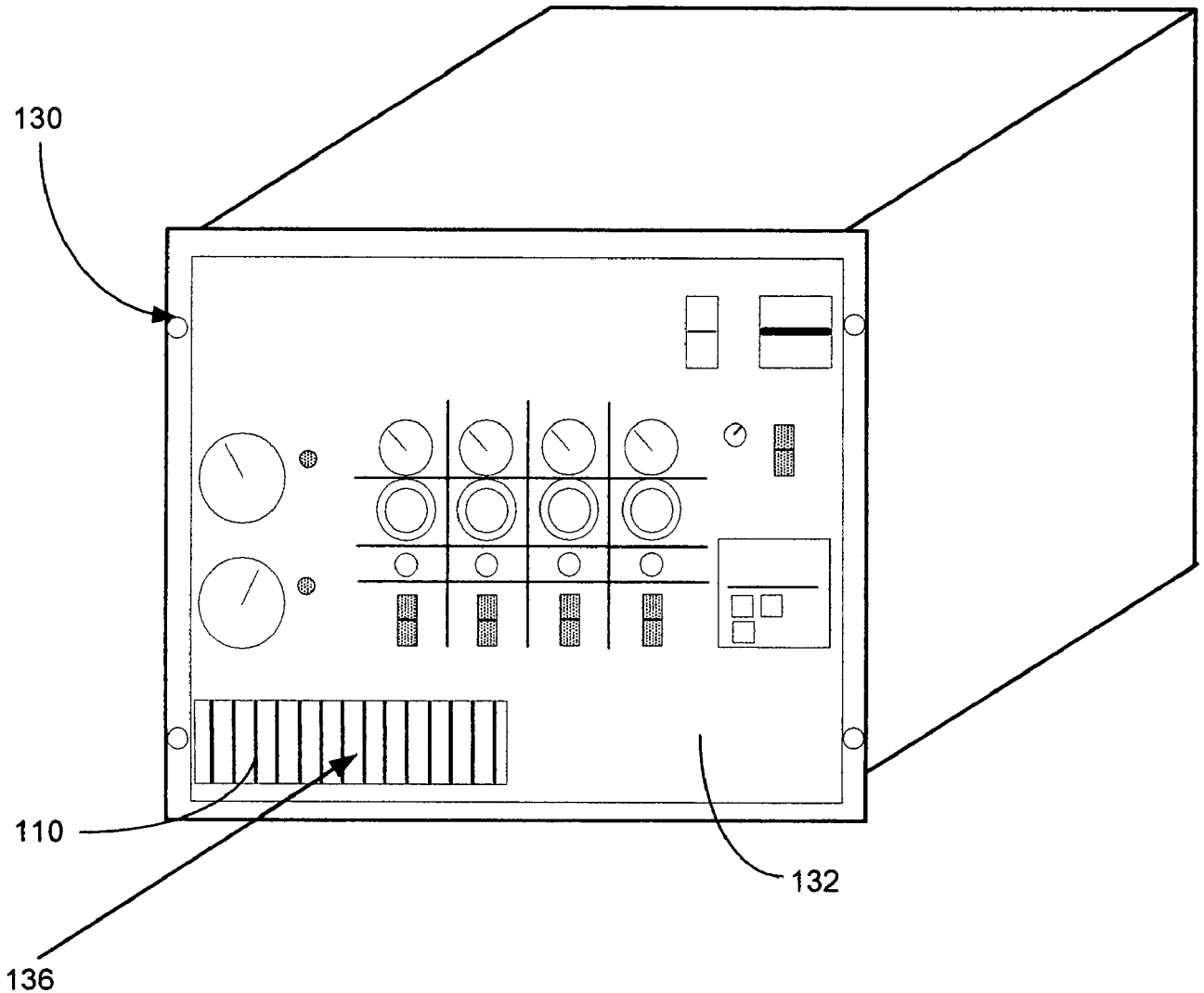
FIG. 11 is a perspective view of an apparatus employing the carbon dioxide snow treatment system of the present invention.
Figure 12:
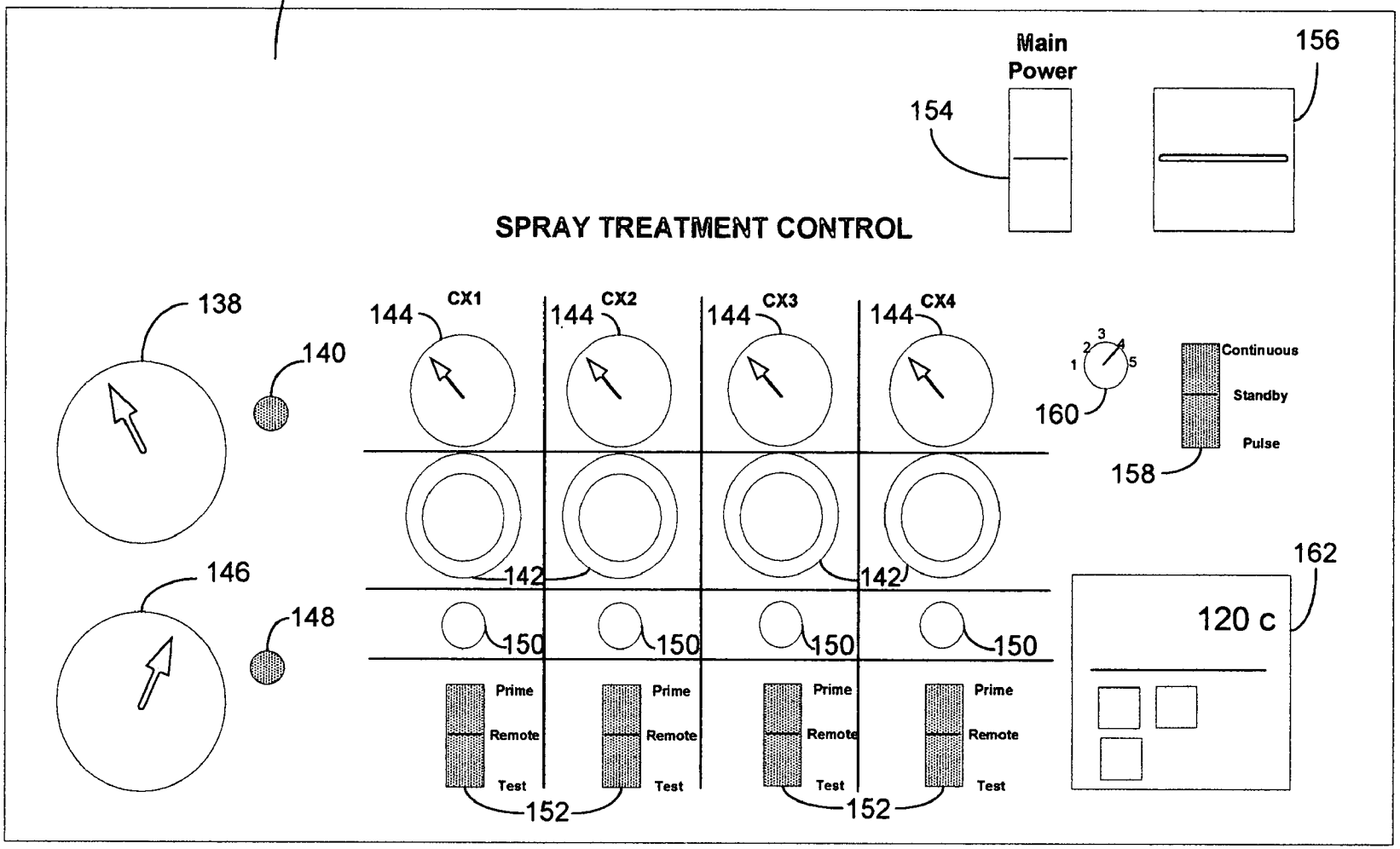
FIG. 12 is a frontal side-view of the apparatus illustrated in FIG. 11.
Figure 13:
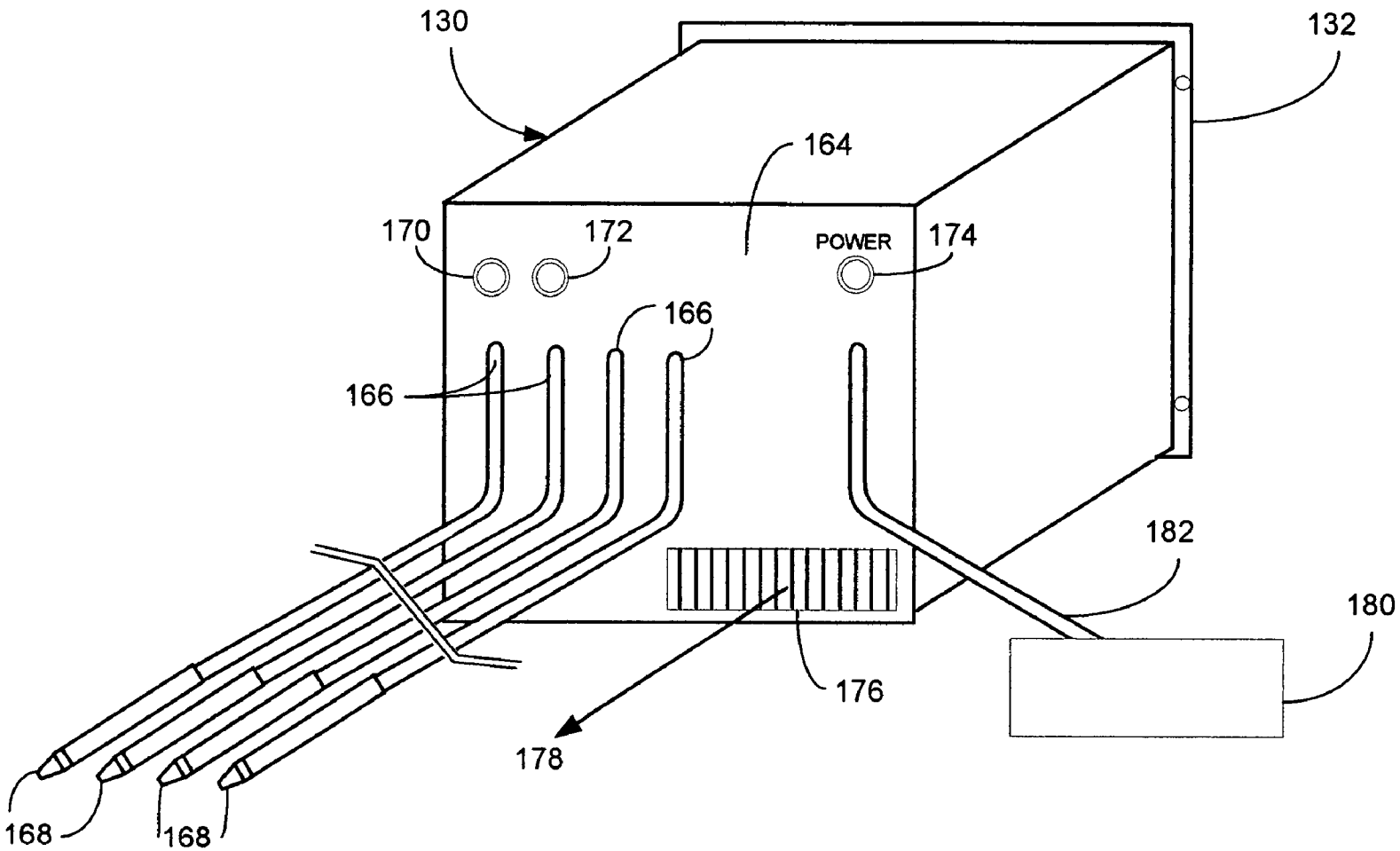
FIG. 13 is a perspective rear-view of the apparatus illustrated in FIG. 11.

Another aspect of the present invention is the incorporation of the previous embodiments into a single enclosed unit. An exemplary product design using the present invention is illustrated in FIGS. 11-13. Referring to FIG. 11, the carbon dioxide snow treatment system 62 is integrated within an electronic console 130, such as a rack-mount configuration. The control system 62 may include a single snow generation subsystem 64 as illustrated in FIG. 9, or several snow generation subsystems 64*a*, 64*b* and 64*c*, as illustrated in FIG. 10. The electronic console includes a front control panel 132 having an air inlet grill 134 to allow cooling air to enter, indicated by the line arrow segment 136, to cool the carbon dioxide snow treatment system 62 contained therein.

Referring to FIG. 12, the exemplary control panel 132 contains operator controls for controlling the propellant subsystem and the snow generation subsystem(s) contained within the electronic console 130. The controls include a propellant supply pressure gauge 138, a low propellant supply pressure indicator light 140, an individual coaxial propellant pressure regulators 142 and pressure gauges 144. The front panel 132 also contains a carbon dioxide gas supply pressure gauge 146, low carbon dioxide gas supply indicator light 148 and discrete liquid carbon dioxide metering valves 150. An operational mode selector switch 152 allows an operator to prime each system 64 by sub-cooling the respective capillary condensers, test the spray cleaning operation, and place the exemplary cleaning system into remote or external machine control mode. A main power switch 154 provides electrical power to the cleaning system through a circuit breaker 156. Preferably, continuous or pulsed spray treatments are implemented in the present invention. Each are enabled using a treatment spray selector switch 158 which upon actuation provides for continuous spray by by-passing the pulse timer, pulse spray cleaning by enabling the pulse timing circuit 80, and an standby mode for preventive maintenance operations. A pulse cycle switch 160 provides a means for increasing and decreasing a pulse cycle period if that mode has been selected using the exemplary cleaning spray switch 158. Finally, a propellant temperature controller 162 provides the operator with a means for adjusting and monitoring propellant gas temperature.

Referring to FIG. 13, the exemplary enclosure 130 also has a rear panel 164 which contains a bank of multiplexed flexible coaxial spray lines 166 with spray applicators 168. Each applicator is individually controlled and supplied by either a single snow generation subsystem or several discrete snow generation subsystems. A rear-mounted plumbing connection 170 for high pressure carbon dioxide gas, an optional CDA gas connection 172 and an electrical power connection 174 are also provided. A rear-mounted vent grille 176 is used to direct heat-laden airflow out of the enclosure 130 as shown by the line arrow segment 178 to remove heat from the carbon dioxide base stock condenser unit 40. Finally, a suitable and remote machine tool controller 180 communicates via a monitoring and control cable assembly 182 with each system 62 to monitor and control functions such as valve actuation, temperature measurement, and oscillation. Machine controllers 180 are those that control the manufacturing tool such as a machining center, lathe, LASER drill, singulation saw, among any variety of other tools requiring in-situ cleaning include, for example, a footswitch, a finger switch, a program logic controller, computer or embedded controllers, and machine tool controllers.

The present invention as described herein may be used as a stand-alone tool or designed and developed as an "integration module" for various machine tools. An integration module is especially useful since it "hybridizes" the manufacturing tool or process. Many commercial manufacturing tools and processes may be hybridized with the present invention. A few examples are described in the following sections.

Clean-Dispense-Cure and Clean-Bond Processes: Adhesive joining of polymethylmethacrylate (PMMA) surface portions.

A commercially available robotic dispensing and curing machine such as that produced by I & J Fisnar of Fair Lawn, N.J. is integrated with the present invention, including operational control interfacing, to form a new hybrid surface preparation, adhesive dispensing and UV curing system. Both portions of a substrate surface are precision treated using at least of the carbon dioxide snow treatment systems of the present invention. Upon treatment, an adhesive is dispensed onto the cleaned surfaces, mechanically contacted, and cured using a UV curing light. A manufacturer using such a product would not require a separate off-line or in-line cleaning and surface pre-treatment system.

Clean-Assemble and Clean-Attach Processes: Mechanically joining surface portions of polyethylene (PE) substrates.

A commercially available automated assembly machine, such as that produced by Automated Tool Systems of Cambridge, Ohio is integrated with the present invention, including operational control interfacing, to form a new hybrid surface preparation and mechanical assembly tool. Firstly, one or both substrate surfaces are precision treated using at least one carbon dioxide treatment systems of the present invention. Upon such treatment, the substrates are mechanically assembled (screwed, riveted, clipped) to form a clean-assembled substrate. A manufacturer using such a product would not require a separate off-line or in-line cleaning and surface pre-treatment system prior to automated assembly.

Drill-Clean and Clean-Inspect Processes: A stainless steel substrate having multiple surface portions to be drilled.

A commercially available automatic drilling machine, such as that produced by Steinhauer Elektromachinen AG of Wurselen, Germany, is integrated with the present invention, including operational control interfacing, to form a new hybrid drilling and cleaning tool. In an automated and sequential process, a portion of the substrate surface is precision drilled, which is followed by spray treatment at least one carbon dioxide treatment system of the present invention to remove residual drilling oils and chips from each hole to form a clean dilled hole. A manufacturer using such a product would not require a separate off-line or in-line cleaning and surface pre-treatment system. A substrate could be machined continuously without interruption. Moreover, no further cleaning is required and the machined surfaces can be inspected directly. Thus this example serves as an example of a clean-inspect aspect as well.

Deburr-Clean Processes: A stainless steel substrate having a surface portion to be robotically deburred.

A commercially available robotic deburring machine, such as that produced by TEC Automation of Canton, Ga., is integrated with the present invention, including operational control interfacing, to form a new hybrid precision deburring and cleaning tool. In an automated and sequential process, a portion of the substrate surface is first precision de-burred, which is followed by a spray treatment with at least one carbon dioxide treatment system of the present invention to remove residual cutting chips and other debris to form a clean, de-burred substrate. A manufacturer using such a product would not require a separate off-line or in-line cleaning process tool or step.

Clean-Weld Processes: Two polypropylene (PPE) substrates having surface portions to be acoustically welded together.

A commercially available automated acoustic welding machine, such as that produced by Branson North America of Danbury, Conn., is integrated with the present invention, including operational control interfacing, to form a new hybrid surface preparation and plastics welding tool. Firstly, both substrate surfaces to be joined are precision treated using at least one carbon dioxide treatment system of the present invention. The substrates are then mechanically assembled to form a clean-assembled substrate. Finally, the clean-assembled substrate is acoustically welded to form a clean-welded substrate. A manufacturer using such a product would not require a separate off-line or in-line cleaning and surface pre-treatment system or process step prior to welding.

Clean-Solder and De-solder-Clean Processes: An electro-optical board having one or more bonding requirements is to be laser soldered following placement of one or more electro-optical components.

A commercially available automated laser soldering machine, such as that produced by Palomar Technologies of Carlsbad, Calif., is integrated with the present invention, including operational control interfacing, to form a new hybrid surface preparation and laser soldering tool. Firstly, the surface to be soldered is precision treated using at least one carbon dioxide treatment system of the present invention. The substrate, with electro-optical component in place, is then laser soldered to form a clean-soldered substrate. A manufacturer using such a hybrid tool would not require a separate off-line or in-line cleaning and surface pre-treatment system prior to soldering. Alternatively, an electro-optical component may be de-soldered using the same hybrid laser soldering and cleaning tool, following which the de-soldered substrate surface may be precision cleaned to remove laser soldering residues and particles. Thus the present invention may be used form a de-solder-clean hybrid tool.

Clean-Coat Processes: A glass substrate having surface portion to be coated with anti-reflectance coating.

A commercially available optical coating system, such as that produced by Leybold Optics GmbH of Alzenau, Germany, is integrated with the present invention, including operational control interfacing, to form a new hybrid surface preparation and optical coating tool. Firstly, optical surfaces to be coated are precision treated using at least one carbon dioxide treatment system of the present invention. The substrates are then coated with an optical coating material to form a particle-free and clean-coated substrate. A manufacturer using such a product would not require a separate off-line or in-line cleaning and surface pre-treatment system or process step prior to coating.

Dice-Clean, Saw-Clean, and Trim-Clean Processes: A ceramic substrate is diced into smaller ceramic chips.

A commercially available dicing machine, such as that produced by Kulicke and Soffa of Willow Grove, Pa., is integrated with the present invention, including operational control interfacing, to form a new hybrid dicing and cleaning tool. Firstly, a ceramic surface is diced to form smaller ceramic chip packages. Prior to removal from the dicing machine, the small chip packages are treated with at least one carbon dioxide treatment system of the present invention to remove dicing debris. A manufacturer using such a product would not require a separate off-line or in-line cleaning and surface pre-treatment system or process step following dicing operations. Similarly, manufacturers producing or utilizing precision sawing equipment would benefit from the integration of the present invention into such a tool.

Figure 14:
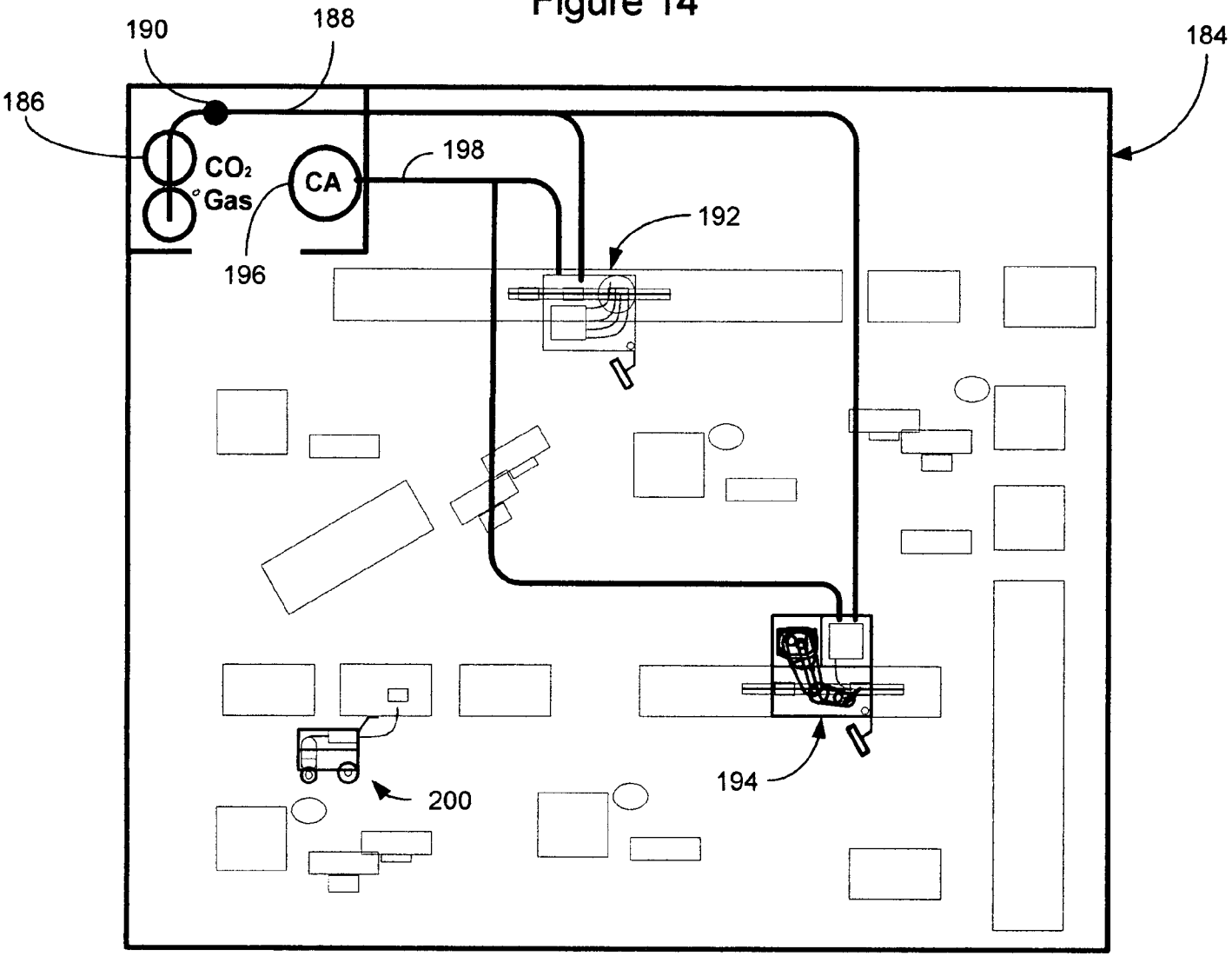
FIG. 14 is a top-view of an exemplary plant floor design incorporating embodiments of the present invention.

The present invention may also be deployed in a number of configurations to provide unique factory cleaning solutions. FIG. 14 illustrates an exemplary factory floor layout 184 showing three possible configurations for the implementation of the present invention. A remote supply of carbon dioxide gas 186 having a pressure of 2.1 MPa (300 psi) is distributed throughout the factory using a network of stainless steel or copper tubing 188 and a pressure distribution pump 190. The pressure distribution pump 190 elevates the carbon dioxide gas supply 186 pressure from 2.1 MPa (300 psi) to a relatively constant distribution carbon dioxide cleaning fluid supply pressure within the network 188 ranging between 5.5 MPa (800 psi) and 6.0 MPa (850 psi). The carbon dioxide cleaning fluid supply network 188 may be connected to one or more carbon dioxide enabled factory tools such as an exemplary in-line tool 192 and robotic spray cleaning tool 194. In addition to and optionally as described herein, a remote source of CDA 196 having a preferred pressure range of between 0.6 MPa (90 psi) and 1.0 MPa (150 psi) may be distributed to these same carbon dioxide enabled tools using a CDA plumbing network 198 comprising stainless steel or copper tubing. Finally, mobile carbon dioxide enabled cleaning tools 200 may be developed using the present invention to provide transportable carbon dioxide cleaning processes within a factory environment for needs such as tool block cleaning.

Figure 15:
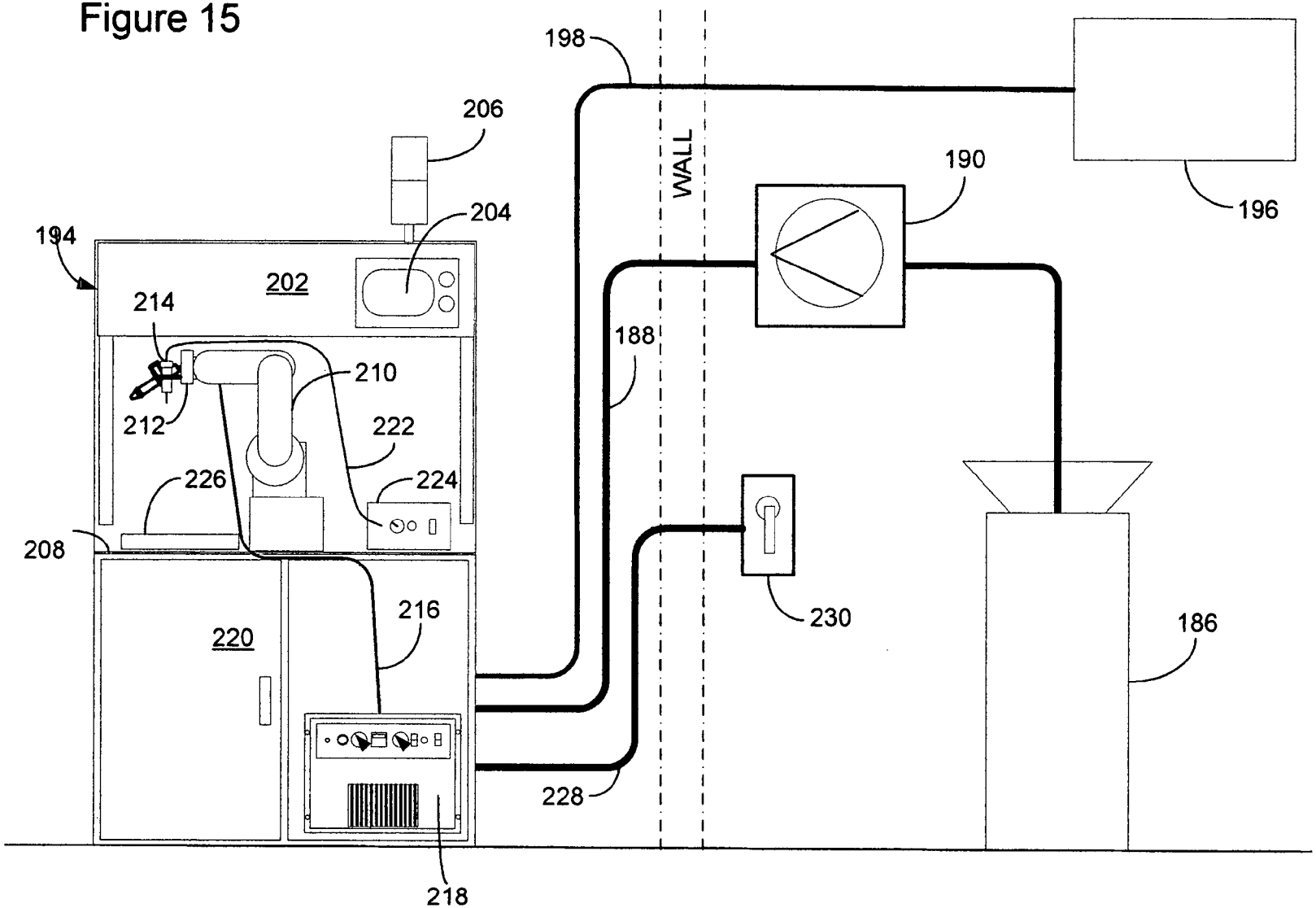
FIG. 15 is a side-view of a control scheme between the present invention and a machine controller.

Referring now to FIG. 15, an exemplary robotic clean-dispensing system 194 includes a workstation 202 having an operator interface panel 204 and process indicator light 206. The exemplary workstation 202 has a work platform 208 which contains articulating robot 210 and robot end-effector 212. The robot end-effector 212 is a combinational tool comprising a carbon dioxide snow treatment apparatus, 20 or 40, and automated dispensing syringe 214. The carbon dioxide snow treatment apparatus, 20 or 40, is connected via a coaxial spray delivery line 216 to the exemplary cleaning module 218 described herein and contained within a lower compartment 220 within the workstation 202. Finally, the dispensing syringe 214 is connected via a pneumatic pressure hose 222 to a dispensing control unit 224.

The exemplary system, including robot articulation, surface cleaning and dispensing operations, as illustrated in FIG. 14 is controlled via an internal PLC or PC control system (both not shown) and associated software. A conveyance system 226 may be used to bring substrates to be processed using the present invention into and out of the exemplary workstation 202, which itself is controlled by same PLC or PC control system.

Also illustrated in FIG. 15 are the exemplary process fluids supplies and connections to the exemplary factory tool. A remote supply of CDA 196 is communicated to the factory tool 194 through a suitable plumbing network 198 which provides pneumatic power to the exemplary workstation 202 as well as propellant supply to the exemplary cleaning module 218. A remote supply of carbon dioxide cleaning fluid 186 is communicated to the exemplary cleaning module 218 via a suitable plumbing network 188 and pressure distribution pump 190. Finally, electrical power is delivered via a suitable line connection 228 and circuit breaker 230.

Although the present invention has been described with reference to preferred embodiments, workers skilled in the art will recognize that changes may be made in form and detail without departing from the spirit and scope of the invention.

The invention claimed is:

1. A carbon dioxide snow generation system comprising a condenser having a first flexible capillary segment connectable to a liquid carbon dioxide feed line and a second flexible capillary segment attached to the first capillary segment, the second capillary segment having a greater inner diameter than the first capillary segment, wherein liquid carbon dioxide enters the first capillary segment from the liquid carbon dioxide feed line and progresses toward the second segment, whereupon entering the second segment, at least a portion of the liquid carbon dioxide condenses into solid carbon dioxide particles.

2. The snow generation system of claim 1 and further comprising a third capillary segment attached to the second capillary segment, the third capillary segment having a greater inner diameter than the second capillary segment, whereupon the liquid carbon dioxide and solid carbon dioxide particles pass from the second capillary segment to the third capillary segment at least a portion of the liquid carbon dioxide further condenses.

3. The snow generation system of claim 1 and further comprising an insulator contacting an outer surface of each capillary segment.

4. The snow generation system of claim 1 and further comprising a conduit, the condenser positionable therein, wherein a gas or fluid is transportable through the conduit and about the condenser.

5. The snow generation system of claim 1 wherein each capillary segment includes an inner diameter ranging from about 0.12 millimeters to about 3.18 millimeters.

6. The snow generation system of claim 1 wherein at least one capillary segment is constructed from a polymer material to provide an insulating effect.

7. The snow generation of claim 1 wherein each segment includes a length ranging from about 0.3 meters to about 7.3 meters.

8. An apparatus for producing solid carbon dioxide particles from liquid carbon dioxide, the carbon dioxide particles deliverable to a nozzle, the nozzle independently positionable relative to the apparatus, the apparatus comprising:

a first flexible tube; and a second flexible tube adjoined to the first tube, the second tube having a greater inner diameter than the first tube, whereupon introducing liquid carbon dioxide into the first tube, the liquid carbon dioxide progresses to the second tube, whereupon entering the second tube at least a portion of the liquid carbon dioxide condenses to form the solid carbon dioxide particles prior to entering the nozzle.

9. The apparatus of claim 8 and further comprising a third tube adjoined to the second tube, the third tube having a greater inner diameter than the second tube, whereupon the liquid carbon dioxide and solid carbon dioxide particles passing from the second tube to the third tube at least a portion of the liquid carbon dioxide further condenses onto to the solid carbon dioxide particles prior to entering the nozzle.

10. The apparatus of claim 9 wherein the third tube is flexible.

11. The apparatus of claim 8 and further comprising an insulator contacting an outer surface of each tube.

12. The apparatus of claim 8 and further comprising a conduit, the first and second tube positionable therein, wherein a gas or fluid is transportable through the conduit and about the first and second tubes.

13. The apparatus of claim 8 wherein the inner diameter of each tube ranges from about 0.12 millimeters to about 3.18 millimeters.

14. The snow generation system of claim 8 wherein each tube has a length ranging from about 0.3 meters to about 7.3 meters.

15. The snow generation system of claim 8 wherein at least one tube includes a polymeric construction to provide an insulating effect.

16. A carbon dioxide snow generation system comprising:

a first tube;

a second tube connected to the first tube, the second tube having a greater inner diameter than the first tube; and a third tube connected to the second tube, each tube constructed from a flexible material, the third tube having a greater inner diameter than the second tube, wherein liquid carbon dioxide enters the first tube and progresses toward the second tube, whereupon entering the second tube at least a portion of the liquid carbon dioxide condenses into solid carbon dioxide particles, whereupon passing from the second tube to the third tube at least a portion of the remaining liquid carbon dioxide further condenses onto to the solid carbon dioxide particles.

17. The snow generation system of claim 16 and further comprising an insulator contacting an outer surface of each capillary segment.

18. The snow generation system of claim 16 and further comprising a conduit, each tube positionable therein, wherein a gas or fluid is transportable through the conduit and about each tube.

19. The snow generation system of claim 16 wherein each tube has a length ranging from about 0.3 meters to about 7.3 meters.

20. The snow generation system of claim 19 wherein the inner diameter of each tube ranges from about 0.12 millimeters to about 3.18 millimeters.

21. The snow generation system of claim 16 wherein the system is coilable.

* * * * *